US006662468B2

(12) United States Patent
Juppi et al.

(10) Patent No.: US 6,662,468 B2
(45) Date of Patent: Dec. 16, 2003

(54) DRYER SECTION OF A PAPER OR BOARD MACHINE

(75) Inventors: Kari Juppi, Palokka (FI); Antti Komulainen, Keuruu (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/322,916

(22) Filed: Dec. 18, 2002

(65) Prior Publication Data

US 2003/0115772 A1 Jun. 26, 2003

(30) Foreign Application Priority Data

Dec. 19, 2001 (FI) ..... 20012514

(51) Int. Cl.[7] ..... F26B 3/00

(52) U.S. Cl. ..... 34/454; 34/447; 34/451; 34/455

(58) Field of Search ..... 34/444, 446, 447, 34/451, 454, 455, 459, 499

(56) References Cited

U.S. PATENT DOCUMENTS

| | | | | |
|---|---|---|---|---|
| 4,359,827 A | | 11/1982 | Thomas | |
| 4,625,430 A | | 12/1986 | Aula et al. | |
| 4,934,067 A | | 6/1990 | Wedel | |
| 5,517,765 A | | 5/1996 | Christansen | |
| 5,933,980 A | * | 8/1999 | Deshpande et al. | 34/446 |
| 6,001,421 A | * | 12/1999 | Ahonen et al. | 427/316 |
| 6,003,245 A | * | 12/1999 | Lipponen et al. | 34/457 |
| 6,418,639 B1 | * | 7/2002 | Virta et al. | 34/455 |

FOREIGN PATENT DOCUMENTS

| | | |
|---|---|---|
| CA | 2156004 | 2/1996 |
| FI | 823496 | 10/1982 |
| FI | 70275 | 2/1986 |
| FI | 93877 | 2/1995 |
| FI | 95729 | 11/1995 |
| FI | 953820 | 2/1996 |
| FI | 963067 | 8/1996 |
| FI | 951748 | 10/1996 |
| FI | 990370 | 2/1999 |
| FI | 106568 | 8/2000 |
| WO | WO 00/50692 A1 | 8/2000 |
| WO | WO 00/50693 A1 | 8/2000 |
| WO | WO 01/94694 A1 | 12/2001 |

OTHER PUBLICATIONS

Search Report issued in Finnish Priority Application No. 20012514.

* cited by examiner

*Primary Examiner*—Timothy L. Maust
*Assistant Examiner*—Kathryn S. O'Malley
(74) *Attorney, Agent, or Firm*—Stiennon & Stiennon

(57) ABSTRACT

A high speed dryer section has single-wire draw drying groups ($R_1$, $R_N$). A paper or board web (W) is supported by a wire (F) as it meanders over drying cylinders (20) in an upper row and reversing cylinders/rolls (21) in a lower row. A first cylinder drying group ($R_1$) has at least five drying cylinders. In the first cylinder drying group ($R_1$) a runnability component (30) is placed in a pocket space defined by every two successive drying cylinders (20) and the reversing roll (21) between them and by the drying wire (F) for applying a high under-pressure of 1000–8000 Pa to an area (50Y) in which the web (W) separates from the drying cylinder (20), and by which runnability component (30) a lower under-pressure of 100–500 Pa is produced in at least part of the rest of the pocket space (T).

15 Claims, 3 Drawing Sheets

DRYER SECTION OF A PAPER OR BOARD MACHINE

CROSS REFERENCES TO RELATED APPLICATIONS

This application claims priority on Finnish Application No.20012514, filed Dec. 19, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a dryer section of a paper or board machine.

As known from the prior art, the dryer section of paper or board machines has employed cylinder drying in which the dryer section is formed of drying groups. In cylinder drying, a paper or board web is dried against the heated surface of a drying cylinder, against which surface the web is generally pressed by means of a wire or equivalent. The drying cylinders are heated, for example, by steam.

The drying groups in the cylinder dryer sections of a paper or board machine employ twin-wire draw and/or single-wire draw. A drying group is formed by the drying cylinders, reversing rolls or cylinders, alignment and guide rolls associated with the same drying wire/belonging to the loop of the same drying wire in single-wire draw or associated with a pair of drying wires/belonging to the loop of a pair of drying wires in twin-wire draw.

In twin-wire draw, the groups of drying cylinders comprise two wires which press the web, one from above and the other one from below, against the heated cylinder surfaces. Between the rows of drying cylinders, which are usually horizontal rows, the web has in twin-wire draw free and unsupported draws which are susceptible to fluttering, which may cause web breaks, in particular in those stages of drying in which the web is still relatively moist and, therefore, has a low strength. For this reason, in the last few years, ever increasing use has been made of said single-wire draw in which each group of drying cylinders comprises only one drying wire on whose support the web runs through the entire group so that the drying wire presses the web against the heated cylinder surfaces of the drying cylinders and the web remains at the side of the outside curve of the reversing cylinders or rolls situated between the drying cylinders.

Thus, in single-wire draw, the drying cylinders are arranged outside the wire loop, and the reversing cylinders or rolls are arranged inside the loop. In what is known as normal single-wire draw groups, the drying cylinders are arranged in an upper row and the reversing cylinders or rolls are arranged in a lower row and, correspondingly, in what is known as inverted single-wire draw groups, the drying cylinders are arranged in a lower row and the reversing cylinders or rolls are arranged in an upper row.

The present invention relates to a dryer section of a paper or board machine, which dryer section applies the so-called normal single-wire draw and which, in addition to drying groups that apply single-wire draw, may also include drying groups that apply impingement drying or through-drying. In high-speed paper or board machines that apply single-wire draw, the first cylinder drying group has posed a special problem; it has been necessary to make it short in high-speed paper or board machines having a speed of, for example, over 1200 m/min when manufacturing fine paper, over 1400 m/min when manufacturing SC paper, over 1500 m/min, advantageously over 1600 m/min when manufacturing newsprint, over 1000 m/min when manufacturing fluting and liner, in order to be able to maintain sufficient tension in the web by means of differences in draw so that no runnability problems should arise. The difference in draw refers to a difference in speed both between a press section and a dryer section and between successive drying groups, in which connection, for providing tension, the following drying group uses a speed that is slightly different from the speed used in the preceding press or drying group. In that case, instead of one group, it has been necessary to place two or more cylinder drying groups at the beginning, which has increased manufacturing and operating costs.

At the beginning of the dryer section, the web does not yet contain a lot of solids, which means that its transfer from the press to the dryer section and its runnability in the first cylinder drying group have been problematic because, when the web is passed from a drying cylinder to a reversing cylinder or roll, the web may have separated from the wire and formed bags, the elimination of which has required a high draw value, which has led to the use of short cylinder drying groups, even groups formed by one cylinder, as the first group of the dryer section. The above-mentioned difference in draw from the press has been used specifically for eliminating the bags described above in order to make runnability good enough. The draw difference affects the quality properties of the web and, for the above-mentioned reasons, it has not been possible to optimize the draw difference taking into account quality properties.

With increasing running speeds of paper or board machines, it has been conventionally necessary to also arrange the long drying groups, for example, 8–9 cylinders, used for easy grades in prior art low-speed machines so that they form, for example, two drying groups in order to get runnability under control by thus providing separate drying groups that enable a difference in draw.

In prior art paper and board machines, the length of the first cylinder drying group has become shorter with increasing machine speeds. Although the solids content after the press has increased in recent years, the length of the first cylinder drying group has nevertheless continued to become shorter in prior art dryer sections that apply today's technology.

In prior art cylinder drying groups that apply single-wire draw, the drying wire and the web come from a preceding drying element, for example, from a contact drying cylinder to a reversing suction cylinder or equivalent as a joint straight run, in which connection a closing wedge space is formed between the drying wire and the surface of the last-mentioned suction cylinder, the wedge space being also called a closing nip in the following. The moving drying wire and cylinder surfaces tend to induce overpressure into said wedge space. This in turn produces a pressure difference that affects the web supported by the drying wire and which tends to separate the web from the drying wire, causing runnability problems, wrinkles and even web breaks. On the other hand, in order to improve the efficiency of dryer sections, there is a need to use dryer sections that are more compact than previously and in which the contact drying cylinders and said suction cylinders are as close to one another as possible. All these matters together with increasing web speeds add to the overpressure problems in said closing nip.

A closing wedge space, i.e. a closing nip, i.e. a closing gap is formed when the wire runs towards the next suction cylinder/drying cylinder between the drying wire and the surface of said next cylinder. In a corresponding manner, an opening wedge space, i.e. an opening gap, i.e. an opening nip refers to a wedge-shaped space which is formed between the drying wire and the surface of the suction cylinder/drying cylinder and from which suction cylinder/drying cylinder the wire separates.

In the case of the opening gap, i.e. opening nip, a problem has been that the web starts to follow the drying cylinder and not the drying wire towards a reversing cylinder. The run of the web in this opening nip between the drying cylinder and the wire becomes the more difficult to control, the higher the paper or board machine speeds become, because with increasing speeds the web is more liable to follow the drying cylinder. The solids content of the web is also important for the separation of the web from the cylinder. The wetter the web, the more difficult is it to separate it from the cylinder. If the web does not follow the drying wire, the web will have slackness, which may cause wrinkles and other problems. The separation of the web from the cylinder and the supporting of it against the wire therefore requires increasingly more efficient methods when speeds are increased.

FI patent applications 19990370 and 19991908 disclose a runnability component which provides a high under-pressure on the rear side of the wire, i.e. on the side opposite to the web at the opening gap, and a lower under-pressure in a pocket space. FI application 19990370 discloses a blow device in a paper machine or another equivalent machine, such as a board or finishing machine, in which the web is conveyed while supported by a wire or equivalent over a cylinder, such as a drying cylinder or another roll, between the cylinder and the wire, and which blow device comprises a blow box or a blow box assembly which extends across the entire width of the web and which is connected to members that produce blowing air, and which blow device is disposed on the side of the wire facing away from the cylinder substantially at the opening nip between the wire and the cylinder to extend at least a small distance forwards from the nip in the running direction of the wire, and provided with at least two sealing members, such as a nozzle slot, an ejection nozzle, a mechanical seal or equivalent, which are transverse to the running direction of the web and disposed close to the wire, which sealing members are disposed in the blow device such that the first sealing member, which is a nozzle, is disposed substantially at the opening nip between the wire and the cylinder to blow air jets away from a gap between the wire and the blow device, and such that the second sealing member is disposed at a distance from this opening nip in the running direction of the wire to blow air jets away from the gap between the wire and the blow device or to limit the flow of air in this gap, whereby the sealing members maintain an under-pressure in the space between the blow device and the web. The blow device is additionally fitted with a throttling member at a small distance from the opening nip, which throttling member projects towards the wire and divides the under-pressure space formed between the first and the second sealing member into a first area of enhanced under-pressure confined to the location of the opening nip and into a second area of lower under-pressure. FI application 19991908 discloses under-pressure control arrangements associated with this.

When used at the beginning of a dryer section of a paper or board machine in demanding (speed, web grade) running conditions, problems have been encountered in prior art applications. One problem has been the differences in draw which are effective between groups. When the web being dried lies freely on the cylinder surface, its edges separate from support and thus the web requires increasingly more draw with increasing speed. In addition, one problem has been posed by the maintenance of web tension because tension disappears when a web of low solids content is stretched, with the result that bags causing runnability problems may be formed in the web. Moreover, the web may form bags when it has no tension and thus the web does not remain tight, which may also cause runnability problems. Stresses in the web are relaxed by the action of temperature, whereby web tension is lowered, which may further cause runnability problems.

In addition, the draw caused by draw differences may impair the other properties of the web, for example, its porosity, oil absorbency, Scott Bond (bonding strength) and roughness. It has not been possible to optimize these properties because runnability has formed the primary basis for determining the differences in draw.

With the conventional drying concept applying the prior art technology it has been problematic to control the properties of the web as desired during drying.

In paper or board machines known from the prior art, between the press and the dryer section, a draw difference of 2–3.5% has been used for fine paper when the running speed of the dryer section has been over 1350 m/min, when making LWC paper (Light Weight Coated) at a running speed of over 1600 m/min, the draw difference has been about 2.8% at its lowest and at a speed of 1800 m/min it has been about 3.1%, and when making newsprint at a running speed of 1600–1800 m/min, the draw differences used have typically been 2.8%, 3.3% and 3.5%.

Thus, in conventional drying concepts that apply known technology, the problematic areas have been the area of the opening nip, where problems have been caused by the fact that the web starts to follow the drying cylinder and does not accompany the drying wire, and the area of the closing nip, where an overpressure has caused the web to form a bag before the web moves onto the surface of the reversing roll, and the third problematic point has been the transfer over a group gap, in which it has not been possible to make the web run from a cylinder to a drying wire of the next drying cylinder group with a small difference in draw and, thus, with low tension, but the web has tended to follow the wire of the preceding group already before the location where the group changes or tended to follow the drying cylinder of the preceding group after the location where the group changes, and when a big draw difference is used, it may have caused problems with the quality of the web.

SUMMARY OF THE INVENTION

An object of the invention is to provide a high-speed dryer section of a paper or board machine having a better runnability than that of the prior art arrangements.

An object of the invention is to provide a high-speed dryer section of a paper or board machine in which no runnability problems are caused in the area of opening and closing nips nor in the transfer over a group gap.

An object of the invention is to provide a dryer section of a paper or board machine in connection with which the difference in draw between the press section and the beginning of the dryer section need not be determined based on runnability but the draw difference can be optimized based on quality properties.

The aim of the present invention is to develop further the technology corresponding to that described above such the problems caused by said opening nip area and closing nip area in the transfer of the web can be largely solved.

In particular, at high speeds at the beginning of a dryer section that applies single-wire draw, the area which is very critical in respect of runnability is the beginning of the dryer section, and a special object of the invention is thus to provide a cylinder dryer section of a paper or board machine in which the beginning of the dryer section does not suffer from the problems described above.

A special object of the invention is also to provide a high-speed dryer section of a paper or board machine in which the first cylinder drying group is long, which means that the web is not subjected to harmful additional draw differences, but the desired draw is arranged between the press and the dryer section by optimizing the quality.

An object of the invention is also to provide a dryer section of a paper or board machine in which there is no need for several drying groups at the beginning of the dryer section to produce draw differences in the web for runnability reasons.

In the paper or board machine in accordance with the invention, the first cylinder drying group is provided with runnability components by means of which it is possible to direct a high under-pressure of 1000–8000 Pa, preferably 2000–4000 Pa, at the opening gap on the rear side of the wire, i.e. on the side opposite to the web, and a lower under-pressure of 100–500 Pa, preferably 200–300 Pa, at another desired part of the pocket space or at all the rest of the pocket space. In connection with the invention, the rest of the pocket space refers either to the entire pocket space other than the area on the rear side of the wire at the opening gap or to a desired part of the rest of the pocket space, i.e., not necessarily the entire area of the rest of the pocket space. For example, a lower under-pressure can be applied only to that part of the wire run from the drying cylinder to the reversing cylinder which is not any more at the opening gap.

So high an under-pressure is directed at the gap opening on the rear side of the wire that the web is transferred easily without any problems, e.g. formation of bags, wrinkles, etc., from the cylinder together with the wire forwards. The magnitude of the under-pressure used naturally depends on running speed and on the paper or board grade being manufactured as well as on other running parameters of the paper or board machine.

In accordance with the invention, in the other drying groups after the first cylinder drying group it is also possible to use other types of conventional blow boxes. The runnability components, so-called high-efficiency blow boxes, used in the first cylinder drying group ensure a good runnability of the web immediately at the beginning of the dryer section when the web is still wet.

In the dryer section of a paper or board machine in accordance with the invention, the first cylinder drying group comprises at least five drying cylinders. In the dryer section of a paper or board machine in accordance with the invention, the number of the drying cylinders in the first drying cylinder group is maximized such that the upper limit for the number of drying cylinders is constituted by the situation in which the web starts to shrink to such an extent that a group gap is needed to achieve runnability past the group gap with a desired, preferably small draw difference, which may be even negative because of the machine direction shrinkage caused by the drying of the web, in which case the next drying cylinder group is thus driven more slowly than the preceding drying cylinder group. In that connection, between the press and the dryer section it is possible to use draw differences of, for example, below 2% at a running speed of over 1200 m/min and below 3% at a running speed of over 1600 m/min.

The number of drying cylinders used in the first cylinder drying group naturally also depends on the diameter of the drying cylinders used and, according to the basic idea, the long first cylinder drying group in accordance with the invention extends at its maximum to a point where the stress produced by shrinkage of the paper or board web starts to have an adverse effect on runnability, at which point the solids content of the web is generally 50–65%, preferably 55–60%, advantageously 55–65%.

The advantage achieved by means of the arrangement in accordance with the invention is, among other things, savings in that, when the first cylinder drying group is long (typically replacing at least two present groups), fewer tensioning/tightening means, guides and wire guide rolls and the like are needed, which means that the manufacturing and operating costs are lower.

In accordance with the invention, a dryer section of a paper of board machine is achieved which has good runnability and which substantially uses only a small draw difference, or needs no draw difference at all, between the end of the press section and the beginning of the dryer section, and thus the runnability of the machine is not a factor that limits the speed of the dryer section of the paper or board machine and its selection quantities of draw difference and other selection quantities, but, instead, it is possible to focus on the quality of the web and/or on desired running speed.

When the dryer section in accordance with the invention is applied, the differences in draw can thus be determined so that they are at optimum values from the standpoint of the quality properties of the web and the running speed, since the runnability problems have been solved by other means. In connection with the dryer section in accordance with the invention, the running parameters can be optimized, for example, based on the properties and beating degree of pulp. Savings in the consumption of energy are obtained by suitable selection of the beating degree.

The invention is particularly suitable, for example, when manufacturing a web from a short fibre chemical pulp or from recycled fibre containing pulps on high-speed paper or board machines.

In connection with the invention, a closed draw is preferably applied from the press section to the beginning of the dryer section.

BRIEF DESCRIPTION OF THE DRAWINGS

In the following, the invention will be described in more detail with reference to the figure of the appended drawing, but the invention is not by any means meant to be strictly limited to the details of it.

DESCRIPTION OF THE PREFERRED EMBODIMENTS

Figure 1:
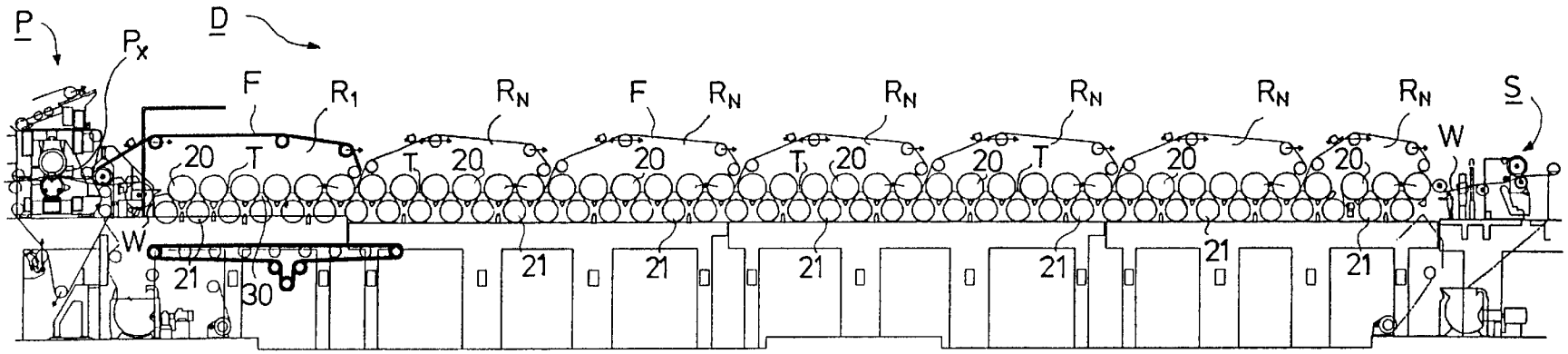
FIG. 1 is a schematic view of one application of the invention for a dryer section of a paper or board machine.

In FIG. 1, a web W is passed from the last press $P_X$ of a press section P as a closed draw to a first cylinder drying group $R_1$ of a dryer section D. After that, in this exemplifying embodiment of the invention, there are six drying groups $R_N$ that apply single-wire draw, after which the web W is passed to finishing, for example, to a calender S.

In the paper or board machine shown in FIG. 1, the drying groups $R_1$, $R_N$ are formed of drying cylinders 20 placed in an upper row and of a reversing roll or cylinder 21 disposed between two successive drying cylinders in a lower row. The reversing roll 21 can be a smooth or a grooved roll or a perforated roll, for example, a reversing suction roll of the type marketed by Metso Paper, Inc. under the trademark VacRoll™. Advantageously, in connection with the dryer section in accordance with the invention, grooved or perforated reversing suction rolls provided with under-pressure, for example, the above-mentioned reversing suction rolls of the type marketed by Metso Paper, Inc. under the trademark VacRoll™, are used as the reversing rolls or cylinders 21, in particular at high running speeds. The web W runs in a meandering fashion from the drying cylinder 20 to the reversing roll 21 and further to the next drying cylinder 20 while supported by a drying wire F. The space defined between two successive drying cylinders 20 and the reversing roll 21 placed in the lower row between them, and the wire F running over them is called a pocket space T.

In accordance with the invention, the first cylinder drying group $R_1$ applies single-wire draw and it has been formed into a long drying group comprising seven drying cylinders 20 in the upper row and, correspondingly, six reversing cylinders/rolls 21 in the lower row.

In accordance with the invention, in the first cylinder drying group $R_1$, a runnability component 30 is placed in each pocket space T between two successive drying cylinders 20 and the reversing roll 21 and the drying wire F for applying a high under-pressure to the rear side of the drying wire, i.e. to the side opposite to the web at an opening gap, and a lower under-pressure to a desired part of the rest of the pocket space T.

The other drying groups $R_N$ of the dryer section are drying groups that apply normal single-wire draw and in which the drying cylinders 20 are in the upper row and the reversing cylinders or rolls 21 are in the lower row.

A conveyor 40 is disposed under the drying group $R_1$, by means of which conveyor it is possible to run the web W taken down, for example, from the last cylinder 20 of the group into a pulper when the tail of the web W is being passed through the remaining drying cylinder groups $R_N$. The conveyor 40 need be operated only when the web is being threaded through the dryer section.

The threading operation in a paper machine provided with a closed press section takes place today with a full-width web to the doctor of the first cylinder, from which it is dropped to a pulper underneath. To pass the tail forwards, a narrow strip, i.e. a leader, is cut out of the web while the rest of the web is guided into the pulper until the leader has been passed through the dryer section and then spread into a full-width web. Although the under-pressures of the runnability component 30 are reduced for the time of threading, at least part of the web guided into the pulper may escape with the leader to the dryer section when it accidentally gets under the action of the under-pressure of the reversing suction roll 21.

The arrangement of the first cylinder drying group $R_1$ in accordance with the invention makes it possible to use high under-pressures in the runnability components and to pass a full-width web in a threading situation through the drying group $R_1$ and after that through a group gap down onto the conveyor 40 and further into the pulper. In the arrangement, the means for cutting a leader may also be situated in their old position, but in the separation point of the leader there is no pulper underneath, from which water vapours might perhaps rise, hampering the process. In addition, the web is drier at the end of the first drying group $R_1$, whereby it is easier to pass the leader forwards than immediately after the press. It is also possible to use the threading process described in the preceding paragraph without any alterations of the devices, for example, at lower speeds or during the servicing of the conveyor 40.

Figure 2:
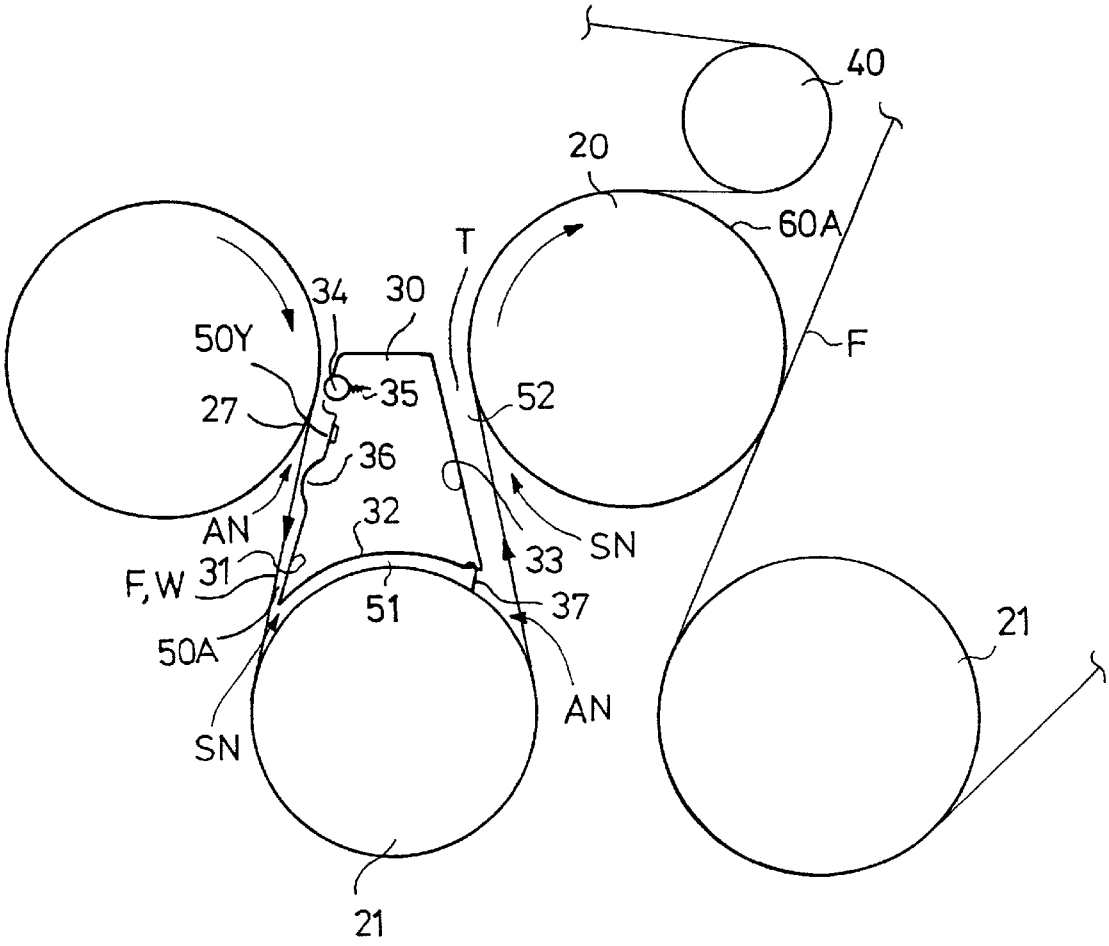
FIG. 2 is a schematic view of one application for a runnability component for use in the first cylinder drying group of a dryer section of a paper or board machine in accordance with the invention.

In FIG. 2, a runnability component 30 is placed in a pocket space T such that its one side 31 defines with a coming wire F a gap-shaped space, which is provided with an under-pressure by means of said runnability component, i.e. a blow box 30. In the upper part of the blow box 30 there is a blow nozzle 34, from which a blow is ejected towards the wire F mainly against the running direction of the wire and such that the blow is effective substantially above the point 27 at which the web W and the wire F separate from the cylinder 20. The primary purpose of the air flow blown from this nozzle 34 is to prevent the air flow coming with the wire F from being carried with the wire F into the narrow gap between the blow box 30 and the wire F. In addition, this blow produces an under-pressure in said gap when it ejects air out of said gap. The nozzle 34 may be attached to the box, for example, by means of a spring 35, which prevents the nozzle 34 from breaking when, for example, a paper clod or equivalent runs past the nozzle 34. A throttling member 36 is disposed at a small distance from the first nozzle, said throttling member dividing said gap-shaped space into two parts; to an upper part 50Y having an enhanced under-pressure and to a lower part 50A having a lower under-pressure. The throttling member 36 prevents air from flowing from the part 50A having a slightly lower under-pressure to the part 50Y having a higher under-pressure. The throttling member 36 can be a mechanical throttling member or it can be formed into a throttling member that operates according to the blow nozzle principle or in another suitable manner in itself known to a person skilled in the art.

The length of the part 50Y having a higher under-pressure is typically 100–300 mm and the area 50A having a lower under-pressure extends to the end portion of the transfer and to a desired part of the rest of the pocket space.

In accordance with the invention, the blow box 30 is used for producing the zone 50Y of enhanced under-pressure, in which the under-pressure is 1000–8000 Pa, preferably 2000–4000 Pa, and the throttling member 36 is used for separating this area from the rest of the pocket space T, in particular from the zone 50A having a lower under-pressure, the under-pressure of which is 100–500 Pa, preferably 200–300 Pa. The under-pressures used naturally depend on the web grade being run on the paper or board machine and on the operating speed used. When this kind of runnability component 30 is used in the first cylinder drying group of the dryer section of the paper or board machine, the runnability problems can be solved and it is possible to use a long drying group comprising 5–12 drying cylinders, preferably 6–10 drying cylinders. The number of the drying cylinders used naturally also depends on the diameter of the drying cylinders used and, in accordance with the basic idea, the long first cylinder drying group in accordance with the invention extends at its maximum to a point where the stress produced by shrinkage of the web starts to have an adverse effect on runnability, at which point the solids content of the web is generally 55–60%. The group gap draw problematic in this respect is at point 60A shown in the figure, at which point the drying wire of the preceding drying group turns away and the web continues to run on the surface of the drying cylinder to the wire of the next drying cylinder group. For example, at point 60A the web does not follow the drying cylinder but the edges of the web start to turn with the wire, as the drying shrinkage of the web makes the web edges more susceptible to turning.

As shown in FIG. 2, a lower part 32 of the box 30 covers the major part of the open portion of the reversing roll 21, i.e. the portion not covered by the wire F, and this gap 51 is small. Air is prevented from being carried with the reversing roll 21 through the gap 51 to the inlet side of the wire F, for example, by a mechanical sealing member 37 or equivalent. As shown in the figure, at the wire run passing from the reversing roll 21 to the next drying cylinder 20, a gap 52 between the blow box 30 and the wire F in the area of a wall 33 can be made so that it widens upwards, whereby air escapes easily. On the other hand, an under-pressure can be produced in the gap 52 and/or the opening gap shape by itself produces an under-pressure that supports the web against the wire on this side as well.

In FIG. 2, the opening nip is designated by the reference sign AN and the closing nip is designated by the reference sign SN.

The enhanced under-pressure in the first part 50Y assists in separating the web W from the surface of the cylinder 20 and in attaching the web W firmly to the wire F. The figure does not show separately the introduction of blow air into the box but its arrangement is in itself known to a person skilled in the art.

With respect to this type of runnability component, reference can also be made, for example, to the applicant's FI patent applications 19990370 and 19991908, which disclose one advantageous arrangement for a runnability component for use in connection with the invention.

Figure 3:
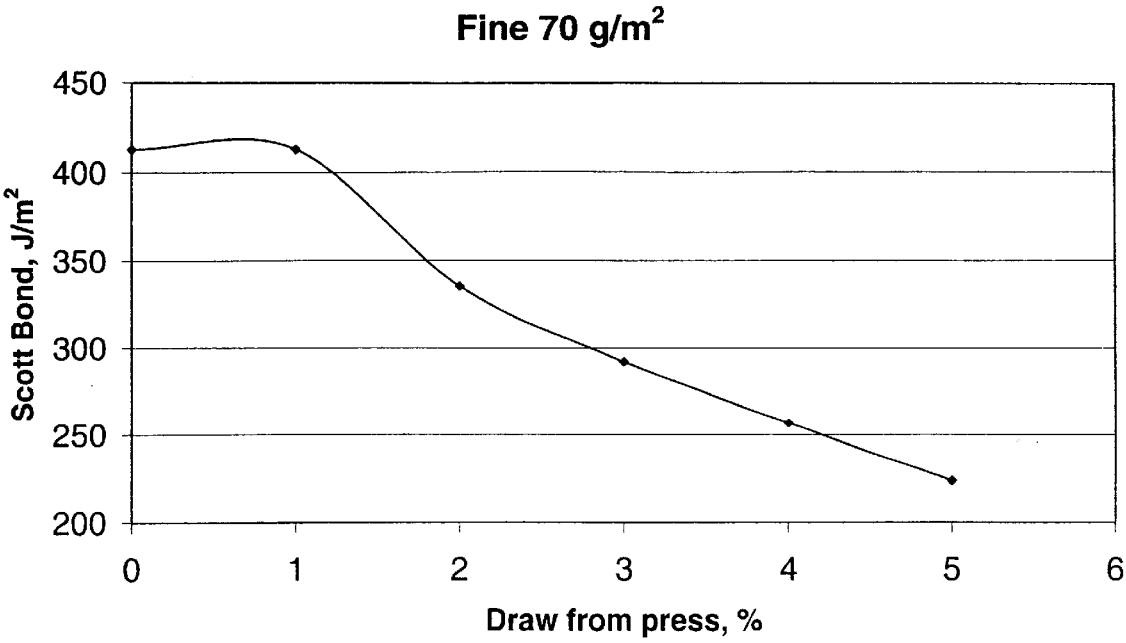
FIG. 3 is a schematic view of one trial result of the dependence between the draw percent of a press and Scott Bond.

FIG. 3 is a schematic view of one example of draw from a press on Scott Bond. Said example is for fine paper 70 g/m$^2$. As seen from the figure, with increasing draw percent, Scott Bond decreases in an undesirable manner.

Figure 4:
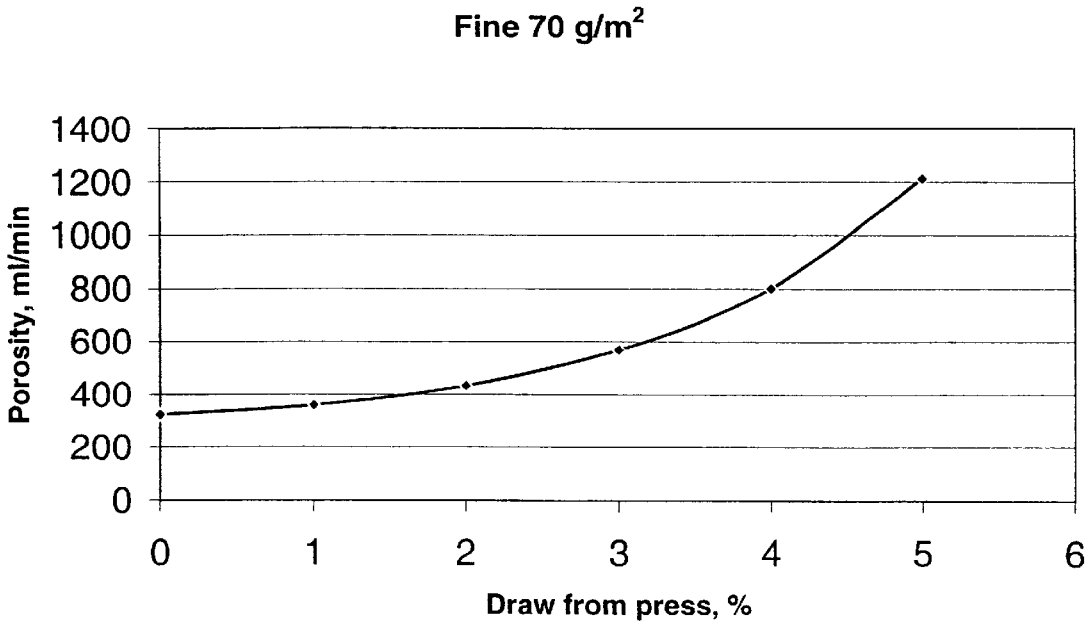
FIG. 4 shows the effect of the draw of a press on porosity as one schematic example.

FIG. 4 is a schematic view of the effect of draw from a press on porosity and, as seen from the figure, with increasing draw, porosity generally increases in an undesirable manner. The example of the figure is for fine paper 70 g/m$^2$.

Above, the invention has been described with reference to some of its advantageous exemplifying embodiments only, but the invention is not by any means meant to be strictly limited to the details of them.

We claim:

1. A method of drying a paper web in a dryer section of a paper or board machine comprising the steps of:

passing a paper web from a pressing section to a first cylinder drying group of the dryer section at a web velocity of at least 1000 meters per minute;

wrapping a first heated dryer cylinder, having a dryer cylinder surface, with the web so that the web is in contact with the dryer cylinder surface, and simultaneously wrapping a drying wire to overlie and travel with the paper web;

wrapping the web and the drying wire about a reversing roll positioned below the first drying cylinder, and below a second heated drying cylinder forming part of the first drying group of dryers, so that the drying wire is positioned against the reversing cylinder;

wrapping the web and the drying wire about the second heated drying cylinder so that the drying wire overlies and travels with the paper web;

positioning a runnability component within a pocket space defined between the first dryer, the second dryer, and the reversing roll;

and in like manner wrapping at least three more heated dryer cylinders and two more reversing rolls to form at least three more pockets in which runnability components are positioned;

operating the runnability components to draw an under-pressure of 1000 to 8000 Pa at selected areas defined where the web and drying wire leave each drying cylinder, and drawing an under-pressure of 100 to 500 Pa, on at least a part of a space defined by the pocket but excluding the selected areas defined where the web and drying wire leave each drying cylinder;

drying the web on the first cylinder drying group of the dryer section until the solids content of the web is 50 to 60 percent;

feeding a portion of the web to a broke conveyor, during threading of downstream drying groups, the broke conveyor being placed under the first cylinder drying group of the dryer section; and passing said portion of the web on the broke conveyor into a pulper of the pressing section.

2. The method of claim 1 wherein the first cylinder drying group of the paper or board machine is a long group to optimize the quality properties of the web and to control the runnability of the web.

3. The method of claim 1 wherein the first cylinder drying group of dryers of the dryer section of the paper or board machine comprises 6–10 cylinders.

4. The method of claim 1 wherein running speed is over 1200 m/min when manufacturing fine paper.

5. The method of claim 1 wherein running speed is over 1400 m/min when manufacturing SC paper.

6. The method of claim 1 wherein running speed is over 1500 m/min when manufacturing newsprint.

7. The method of claim 1 wherein running speed is over 1600 m/min when manufacturing newsprint.

8. The method of claim 1 wherein, the dryer section of the paper or board machine comprises only drying groups that apply single-wire draw.

9. The method of claim 1 wherein the web is passed from a press section as a closed draw while supported by the wire to the first cylinder drying group of the dryer section.

10. The method of claim 1 wherein the runnability components used in the first cylinder drying group of the dryer section of the paper or board machine include a throttling member for defining an area having a higher under-pressure and an area having a lower under-pressure in a gap-shaped space between the wire and the runnability component when the wire runs from the drying cylinder to the reversing roll.

11. The method of claim 1 wherein the runnability components of the first cylinder drying group of the dryer section include a sealing member to prevent air from being carried with the reversing roll into a closing nip of the reversing cylinder.

12. The method of claim 1 wherein, when the running speed is over 1600 m/min, the difference in draw between the press and the dryer section is below 3 percent.

13. The method of claim 1 wherein, when the running speed is over 1200 m/min, the difference in draw between the press and the dryer section is below 2 percent.

14. The method of claim 1 wherein the reversing rolls are reversing suction rolls.

15. The method of claim 1 wherein the first cylinder drying group of the dryer section of the paper or board machine extends at its maximum to a point where the stress produced by the shrinkage of the paper or board web starts to have an adverse effect on runnability, at which point the solids content of the web is 55–60 percent.

* * * * *